US006887045B2

(12) United States Patent
Schaeffer

(10) Patent No.: US 6,887,045 B2
(45) Date of Patent: May 3, 2005

(54) HYDRAULIC TRANSFORMER

(75) Inventor: Rudolf Schaeffer, Marktheidenfeld (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/332,873

(22) PCT Filed: Jun. 28, 2001

(86) PCT No.: PCT/DE01/02387

§ 371 (c)(1),
(2), (4) Date: Jan. 13, 2003

(87) PCT Pub. No.: WO02/06669

PCT Pub. Date: Jan. 24, 2002

(65) Prior Publication Data

US 2003/0113212 A1 Jun. 19, 2003

(30) Foreign Application Priority Data

Jul. 13, 2000 (DE) ..... 100 34 238

(51) Int. Cl.[7] ..... F04B 17/00; F01B 13/04
(52) U.S. Cl. ..... 417/225; 91/499; 92/57
(58) Field of Search ..... 417/225; 91/499, 91/505, 508, 472, 6.5; 60/419; 92/57, 71

(56) References Cited

U.S. PATENT DOCUMENTS

| | | | | |
|---|---|---|---|---|
| 3,079,864 A | | 3/1963 | Drutchas et al. | 103/57 |
| 3,126,835 A | * | 3/1964 | Kline | 91/507 |
| 3,188,963 A | | 6/1965 | Tyler | 103/2 |
| 3,627,451 A | * | 12/1971 | Kouns | 417/271 |
| 4,142,452 A | * | 3/1979 | Forster et al. | 91/506 |
| 4,787,828 A | | 11/1988 | Schweitzer et al. | 417/217 |
| 5,230,274 A | * | 7/1993 | Yu et al. | 91/499 |
| 5,466,135 A | * | 11/1995 | Draskovits et al. | 418/268 |
| 5,688,111 A | * | 11/1997 | Takai | 417/298 |
| 5,878,649 A | * | 3/1999 | Raab | 92/12.2 |
| 6,116,138 A | * | 9/2000 | Achten | 91/6.5 |
| 6,419,585 B1 | * | 7/2002 | Kimura | 464/32 |

FOREIGN PATENT DOCUMENTS

| | | | |
|---|---|---|---|
| DE | 39 13414 | 10/1990 | F04C/15/04 |
| GB | 1 470 956 A | 4/1977 | F04B/9/08 |
| WO | WO 97/31185 | 8/1997 | F04B/1/30 |
| WO | WO 99/40318 | 8/1999 | F04B/1/20 |
| WO | WO 99/61798 | 12/1999 | F04C/15/04 |

* cited by examiner

*Primary Examiner*—Charles G. Freay
(74) *Attorney, Agent, or Firm*—Boyle Fredrickson Newholm Stein & Gratz S.C.

(57) ABSTRACT

A hydraulic transformer wherein a multiplicity of displacers are guided in a displacement member. The stroke of the displacers is determined through the intermediary of a cam element, with pressure medium supply and discharge being controlled through the intermediary of a control member having at least three control grooves. In accordance with the invention either the displacement member or the cam element or the control member may be driven, whereas—depending on which component is driven—the cam element or the displacement member is mounted so as to be freely adjustable, and the remaining third component is accommodated integral with the housing.

11 Claims, 3 Drawing Sheets

HYDRAULIC TRANSFORMER

BACKGROUND OF THE INVENTION

1. Field of the Invention

The invention relates to a hydraulic transformer, and more particularly, a hydraulic transformer that provides efficient adjustment of the transformation ratio based on, for example, rotation speed of the drive mechanism.

2. Discussion of the Related Art

A hydraulic transformer is a unit wherein an energy flow $Q_1 \times P_1$ is transformed into an energy flow $Q_2 \times P_2$ through hydraulic coupling of a hydrostatic motor and a pump. In the process, only the amount of energy required for driving a consumer that is connected to the pump is withdrawn from an existing pressure supply. Such hydraulic transformers may be designed as radial piston engines or axial piston engines.

U.S. Pat. No. 3,188,963 discloses a hydraulic transformer having the form of a swashplate motor, wherein displacers guided in a rotatable cylinder are supported on a stationary swash plate. The angle of the swash plate determines the piston stroke of the displacers. Pressure medium supply and discharge are performed with the aid of a control disc having four control kidneys, wherein the respective pairs of control kidneys are associated with the motor and the pump.

In U.S. Pat. No. 3,079,864 a hydraulic transformer in vane-cell construction is disclosed. In this solution, a multiplicity of displacers translatable in a radial direction are mounted in a rotor and biased against a cam ring. Pressure medium supply and discharge are performed, similar to the above described solution, with the aid of a control disc arranged on the front end side.

From WO 97/31185 A1 and from the reference, "Ein neuer alter Bekannter—der Hydrotransformator", Siegfried Rotthäuser, Peter Achten; O+"P Ölhydraulik und Pneumatik" 42 (1998) No. 6; p. 374 et seq., the so-called INNAS hydraulic transformer is known, wherein the transformation ratio, i.e. the ratio between the supply pressure and the load pressure of the consumer, is variable. To this end, the control disc is provided with three control kidneys, whose relative positions to the dead center positions of the displacers are changeable by rotating the control disc relative to the swash plate of the axial piston machine. By adjusting the control disc, the equilibrium of torques across the swash plate is changed. For shutting down the hydraulic transformer, the control disc must be taken into a neutral position in which the sum of torques acting on the swash plate is zero. Regulation for accurate adjustment of the control disc rotary position necessary for a predetermined transformation ratio is comparatively sophisticated.

SUMMARY OF THE PRESENT INVENTION

Before this background, the invention is based on the object of providing a hydraulic transformer affording simple adjustment of the transformation ratio.

This object is achieved through a hydraulic transformer constructed according to the present invention.

In accordance with the invention, the hydraulic transformer is provided with a displacement member accommodating the displacers, a cam element acting on the displacers in the direction of stroke, and a control member controlling pressure medium supply to a tank port, a work part and a supply port, with one of these elements being capable of being rotatingly driven by means of a drive mechanism.

Depending on which component is driven, the displacement member or the cam element is mounted in a housing of the hydraulic transformer such that it may freely adjust itself as a result of the reaction forces. The respective third component, i.e. the non-driven or freely adjustable component, is fixedly mounted in the housing.

As a result of one of the components being driven, the transformation ratio is substantially determined by the rotational speed of the drive mechanism, so that the adjustable pressure at the consumer thus is a function of the rotational speed of the driven component and of the available supply pressure. Upon deactivation of the drive mechanism, the hydraulic transformer owing to the free movability of the second component immediately assumes an equilibrium position that is dependent on the supply pressure and on the load pressure, and wherein no torques are acting: the hydraulic transformer is automatically returned, without a complicated feedback control as in the INNAS hydraulic transformer being necessary.

The solution in accordance with the invention permits an extremely simple adjustment of the transformation ratio in dependence on the rotational speed of the drive mechanism, wherein operating safety is substantially enhanced in comparison with the conventional solutions as the equilibrium position is assumed automatically as soon as the drive mechanism is deactivated.

Thanks to rotary speed control of the drive mechanism, the various transformation ratios may be adjusted in an extremely simple manner. At a constant pressure ratio, the flow rate of the hydraulic transformer is proportional to the set rotational speed.

The basic concept in accordance with the invention may be realized in hydraulic transformers both in axial and in radial design.

Depending on requirements, the driven component, the stationary component and the automatically adjusting component may be realized in the following preferred variants.

In a particularly advantageous embodiment, the displacement member receiving the displacers is fixedly mounted in the housing, whereas the control member may be driven by the drive mechanism, and the cam member is rotatably mounted in the housing. Owing to the stationary displacement members, the masses to be accelerated are substantially reduced in comparison with the conventional solution where the displacers together with the associated rotor have to be accelerated, so that more accurate and more rapid adjustment of the transformation ratio at minimized losses is possible.

In a second variant, the control member is fixedly mounted and the displacement member it rotatably mounted in the housing, whereas the cam member acting on the displacers is driven.

In a third alternative, the displacement member is driven, whereas the control member is fixedly mounted and the cam element is rotatably mounted in the housing.

In particularly preferred embodiments, the hydraulic transformer is realized in axial piston design (swash plate) or as a vane-cell machine.

Further advantageous developments of the invention are subject matters of the remaining subclaims.

BRIEF DESCRIPTION OF THE DRAWINGS

In the following, preferred exemplary embodiments of the invention shall be explained in more detail by referring to schematic drawings, wherein.

DETAILED DESCRIPTION OE THE PREFERRED EMBODIMENTS

Figure 1:
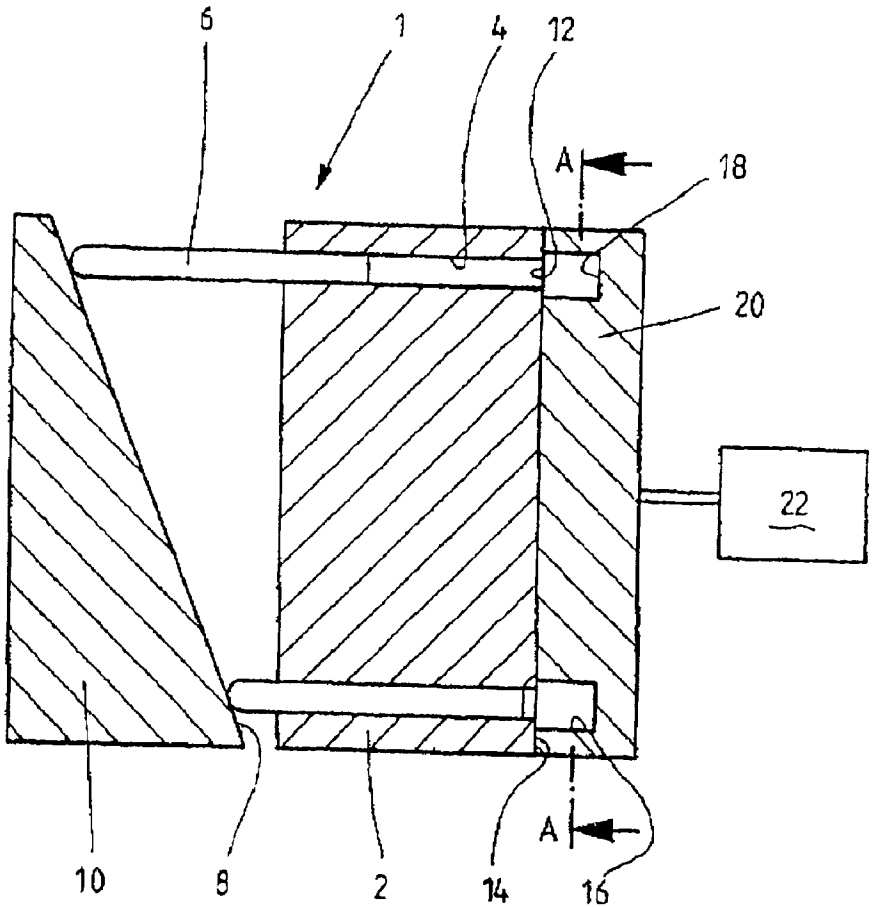
FIGS. 1 and 2 are schematic sectional views of an inventive hydraulic transformer in axial piston design.
Figure 2:
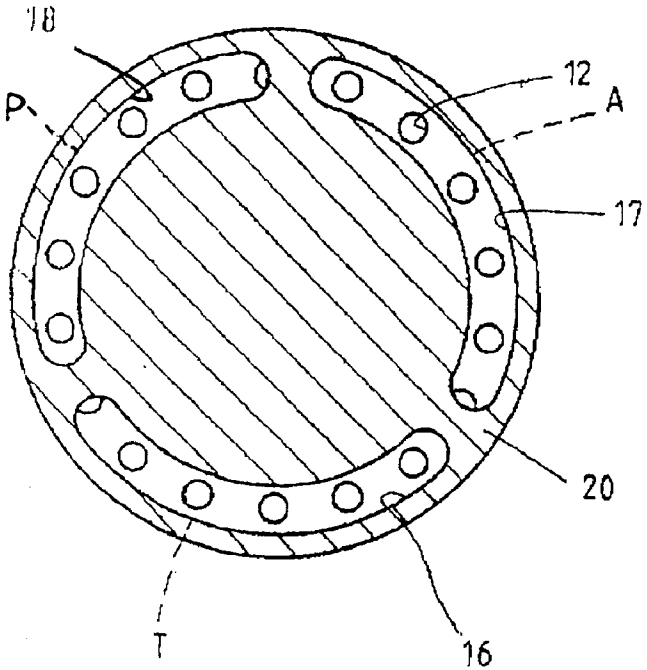
Figure 3:
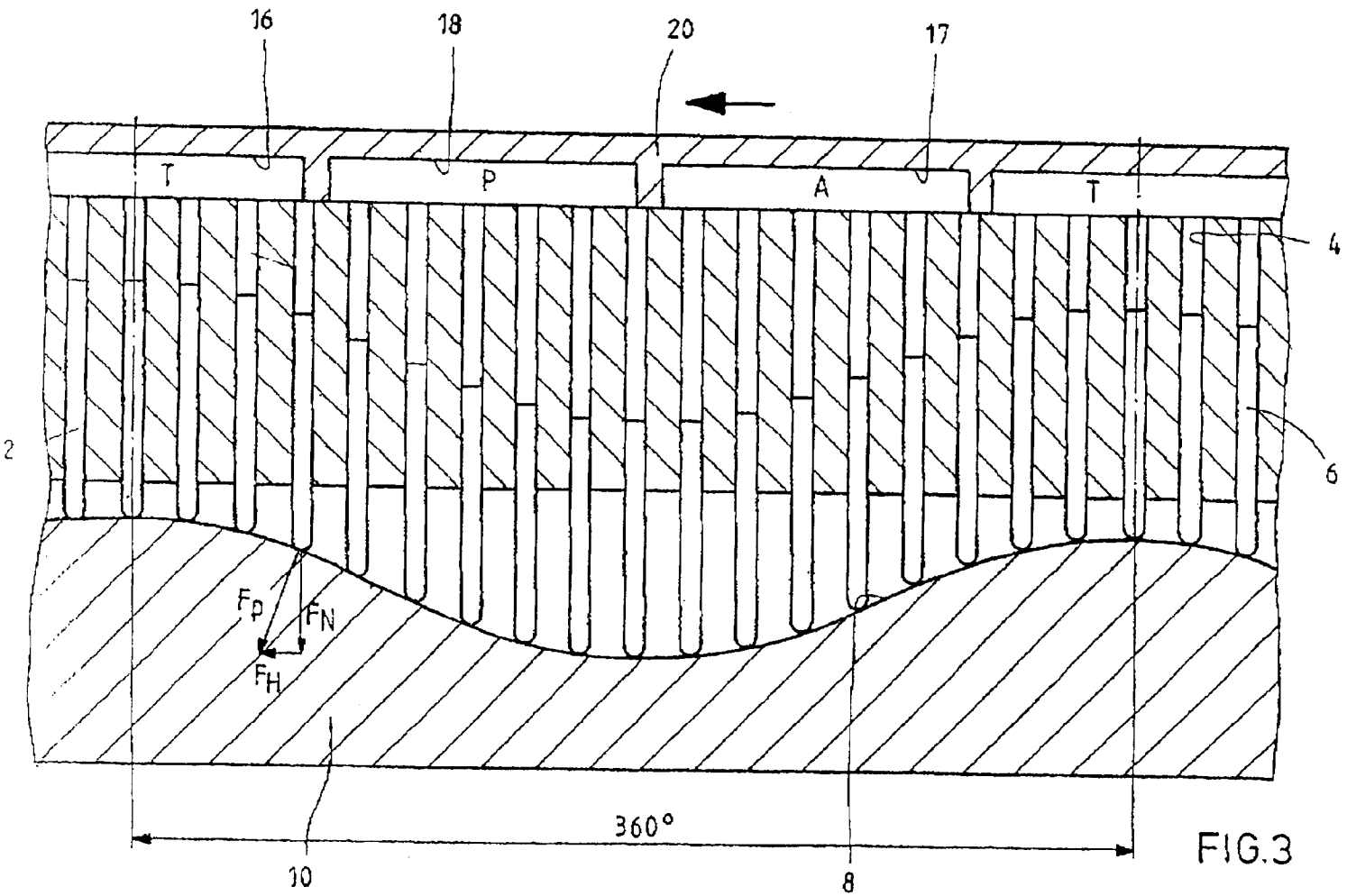
FIG. 3 shows a developed view of the hydraulic transformer of FIG. 1 for elucidating the operation.

In FIGS. 1 to 3, a first embodiment of a hydraulic transformer 1 in accordance with the invention is represented which is realized in axial piston design. FIG. 1 shows a strongly simplified longitudinal section through a hydraulic transformer 1 having a multiplicity of axially extending cylinder chambers 4 formed in a drum 2 along a partial circle. In the represented embodiment a total of eighteen cylinder chambers are formed in the drum 2. In each cylinder chamber 4 a piston-shaped displacer 6 is guided, the piston foot of which is supported directly or through the intermediary of sliding blocks—on an oblique surface 8 of a swash plate 10. The cylinder chambers 4 open into the front face 14 of the from 2 facing away from the swash plate 10 via control openings 12.

There are associated to the altogether eighteen control openings 12 three control kidneys 16, 17, 18 of a control disc 20 which is sealingly mounted on the front end face 14. The three control kidneys 16, 17, 18 are connected with a supply port P, a work port A, and a tank port T, respectively, which are indicated in FIG. 2.

In accordance with the invention, there is associated either to the swash plate 10, to the drum 2, or to the valve plate 20 a separate drive mechanism whereby that component may be made to rotate. Depending on which component is driven, either the drum 2 or the swash plate 10 are mounted in a housing (not shown) of the hydraulic transformer 1 so as to be freely adjustable, whereas the respective third component is fixedly mounted in the housing.

In the embodiment represented in FIG. 1, it is assumed that the valve plate 20 may be driven through the intermediary of a drive mechanism 22 of its own with rotational speed control. In this embodiment the drum 2 is mounted so as to rotate integrally with the housing—i.e., the expression "drum" does not necessarily define rotatable mounting of this component in the housing. The swash plate 10 is in this embodiment rotatably mounted in the housing, with the rotary position occurring in accordance with the torques transmitted by the displacer 6 onto the oblique surface 8.

This torque depends on the radius of the partial circle on which the displacers 6 are arranged, and on the pressure acting on the supply port (high pressure) and on the work port (load pressure). At a constant pressure ratio, the flow rate is proportional to the rotational speed of the valve plate 20 which may be adjusted through the drive control of the drive mechanism 22.

When the drive mechanism 22 is deactivated, the swash plate 10 automatically assumes an equilibrium position wherein the sum of torques acting on it is zero—the hydraulic transformer is thereby returned to zero in the case of a power failure, for instance, so that no pressure medium supply to the work port takes place. This is a considerable safety advantage of the hydraulic transformer in accordance with the invention.

As the comparatively heavy drum 2 including the displacers 6 does not rotate in the described embodiment, the moved masses are relatively small in comparison with conventional solutions, so that a higher rotational speed level may be adjusted.

At a same driving torque, the hydraulic transformer may be operated more dynamically than an INNAS hydraulic transformer.

As was mentioned in the introduction of the description, the invention positively is not limited to a driven valve plate 20 with a stationary drum 2 and a freely adjustable swash plate 10—in principle it would also be possible for the other two components, i.e., the swash plate 10 or the drum 2, to be driven by means of the drive mechanism 22 whereas the two other components are stationary or rotatingly arranged in the housing in the configuration of Table 1.

| FUNCTION/ VARIANT | Driven | Rotatable | Fixed |
|---|---|---|---|
| 1 | Valve plate | Swash plate | Drum |
| 2 | Drum | Swash plate | Valve plate |
| 3 | Swash plate | Drum | Valve plate |

In accordance with Table 1, any combinations may accordingly be realized, with the exception of the one combination where the valve plate is freely rotatable, or the swash plate is fixedly mounted in the housing. The term "swash plate" here also encompasses the axial piston constructions including a wobble plate or bent axis.

FIG. 3 shows a schematic developed view of the hydraulic transformer 1 represented in FIG. 1, in which the interactions of the single components may be seen best, wherein the relative arrangements of the single components during a complete rotation of the valve plate 20 through 360° are represented. The cam disc which determines the lifting movement of the displacers 6 as defined by the oblique surface 8 is automatically adjusted as a result of the disturbed equilibrium of torques as a function of the angular position of the control disc 20 and of the pressures acting at the ports P, A and T. The drum 2 is fixed relative to the valve plate 20 and to the swash plate 10.

When the drive mechanism 22 is deactivated, i.e. while the valve plate 20 is stationary, the swash plate 10 having the oblique surface 8 that acts as a cam disc adjusts itself as a result of the torques acting on it such that the torque acting on the swash plate 10 is zero. The equilibrium position represented in FIG. 3 occurs when about the same pressure prevails at the supply port as at the work port (load pressure). In the case of a negligible load pressure at work port A, the swash plate 10 will shift to the left from the representation in accordance with FIG. 3 until the displacers 6 subjected to high pressure via the control kidney 18 are arranged in the valley of the cam disc formed by the oblique surface 8.

When the control disc 20 is driven in the direction of the arrow, the displacer chambers 4 operatively connected with the supply port P are successfully subjected to the supply pressure, so that the swash plate 10 is moved to the left due to the compressive force component $F_H$ acting in the horizontal direction.

In the above described embodiment, the hydraulic transformer is realized in axial piston design. The invention is, however, not limited to axial piston machines but may also be applied with other displacement principles, for example in radial piston machines, cycloidal gears, vane-cell machines, etc.

Figure 5:
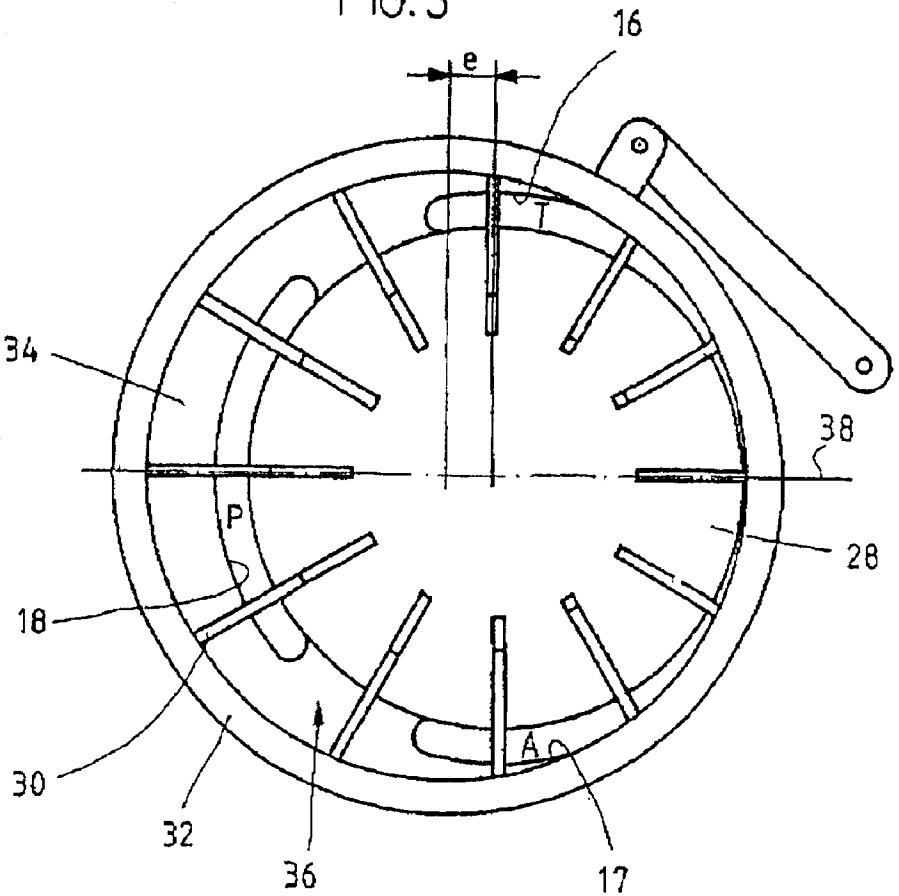
FIGS. 4 and 5 show an embodiment of an inventive hydraulic transformer having the form of a vane-cell machine in two different operating conditions.
Figure 4:
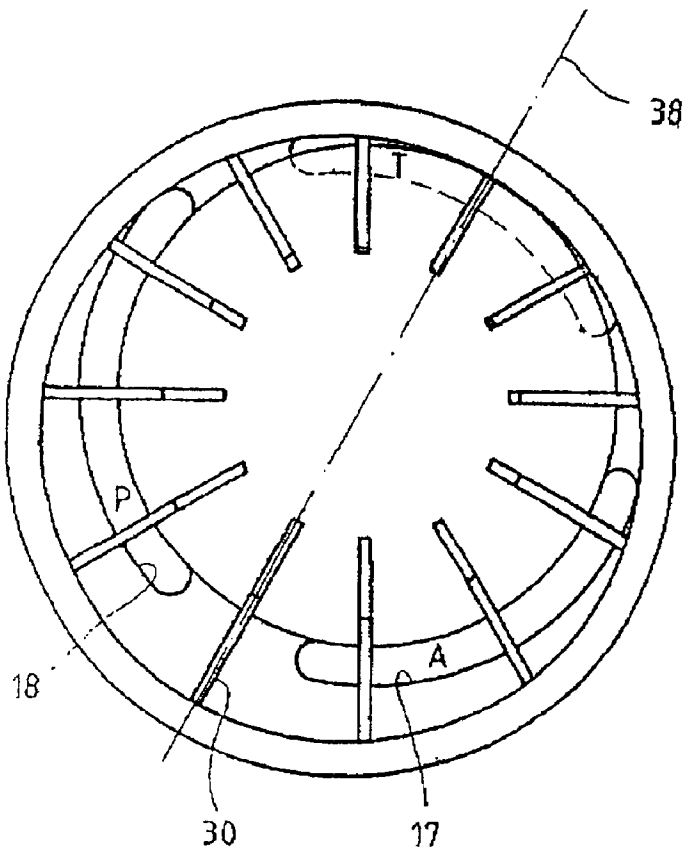

FIGS. 4 and 5 show strongly simplified sectional views of a second embodiment of a hydraulic transformer 1 realized in a vane-cell design. A like vane-cell unit comprises a rotatably mounted rotor 28 provided on the periphery with radial recesses in which radially displaceable vanes 30 are guided. The end portions of the vanes 30 which radially protrude from the rotor 28 are supported on a cam ring 32 offset from the rotor 28 by the throw of eccentricity e. In accordance with the representation in FIGS. 4 and 5, the cam ring 32 reaches around the rotor 28 with the vanes 30. Two adjacent vanes 30 and the mutually facing peripheral walls of cam ring 32 and rotor 28 define displacer chambers 34 that are defined on the front side by a valve plate 36 on the one hand and by a front plate (not shown) on the other hand. The valve plate 36, similar to the previously described embodiment, comprises three control kidneys 16, 17, and 18 that are associated to tank port T, work port A, and supply port P, respectively. With the aid of these control kidneys it is therefore possible to connect the above mentioned displacer chambers 34 with the supply port, the work port or the tank port depending on the relative positions of the components.

In the embodiment represented in FIGS. 4 and 5, the rotor 28 with the vanes 30 practically corresponds to the drum 2 with the displacers 6, with the cam ring 32 corresponding to the swash plate 10. The valve plate 36 constituting the front end side termination and comprising the control kidneys 16, 17, 18 is practically identical with the valve plate 20 of FIGS. 1 to 3 with regard to function. With these associations, the variants in accordance with Table 1 may also be transferred to vane-cell units.

In the embodiment represented in FIGS. 4 and 5, the valve plate 36 with the control kidneys 16, 17, 18 is fixedly mounted in the housing (not shown) of the hydraulic transformer 1, whereas the rotor 28 with vanes 30 may be driven through a drive mechanism with rotational speed regulation. As an alternative, the "rotor" may also be fixedly mounted in the housing. The cam ring 32 is mounted in the housing such that it may assume an orientation in dependence on the reaction forces in a particular rotary position with regard to the rotor 28. In other words, this free adjustability essentially includes an adjustment through a wobbling motion of the cam ring 32.

FIG. 4 shows an equilibrium position which occurs when the pressure at supply port P is approximately equal to the pressure at consumer port A. The two control kidneys 17 and 18 are then arranged symmetrical with respect to the axis of symmetry 38 containing the two dead-center positions of the vanes 30.

When the load pressure at work port A is approximately identical with the pressure at tank port T, then the equilibrium position represented in FIG. 5 occurs, in which the control kidney 18 connected with the supply port P is symmetrical to the axis of symmetry 38 defining the dead-center positions.

In a case where the rotor 28 is driven through the speed-controlled drive mechanism, the equilibrium of torques acting on the cam ring is disturbed in the same way as in the above described embodiment, so that the cam ring is rotated in a direction toward its new equilibrium position in accordance with the ratio of pressures at work port A and at consumer port P. Owing to the Circulatory movement of the movement of rotor 28, the cam ring 32 also performs a wobbling motion. At a constant transformation ratio between supply port P and work port A, the flow rate is proportional to the rotational speed of the rotor 28. In correspondence with the above described embodiment, it would alternatively also be possible to drive the cam ring 32 or the valve plate 36, wherein the component freely adjusting itself in a direction toward the equilibrium position always has to be either the rotor 28 or the cam ring 32. For the rest, the function of the hydraulic transformer represented in FIGS. 4 and 5 conforms with that of FIGS. 1 to 3, so that further explanations may be omitted.

It is essential in the invention that one of the components determining the pressure transformation, i.e. the displacement member (rotor 28, drum 2), the cam element (cam ring 32, swash plate 10) or the control member (valve plate 20, 36) may be driven under rotational speed control, whereas—in accordance with what component is driven—the displacement member or the cam element is mounted so as to be freely adjustable, whereas the remaining third component is fixedly accommodated in the housing.

What is disclosed is a hydraulic transformer wherein a multiplicity of displacers are guided in a displacement member. The stroke of the displacers is determined through the intermediary of a cam element, with pressure medium supply and discharge being controlled through the intermediary of a control member having a least three control grooves. In accordance with the invention either the displacement member or the cam element or the control member may be driven, whereas—depending on which component is driven—the cam element or the displacement member is mounted so as to be freely adjustable, and the remaining third component is accommodated integral with the housing.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

LIST OF REFERENCE SYMBOLS

1 hydraulic transformer
2 drum
4 cylinder bore
6 displacer
10 swash plate
12 control opening
14 front end face
16 control kidney
17 control kidney
18 control kidney
20 valve plate
22 drive mechanism
28 rotor
30 vane
32 cam ring
34 displacer chamber
36 valve plate
38 axis of symmetry

What is claimed is:

1. A hydraulic transformer comprising a multiplicity of displacers guided in a displacement member, delimiting a variable displacer volume, and supported on a cam element, wherein a pressure medium supply and discharge are controllable with the aid of a control member, the control member comprising at least three control kidneys that are connected with a work port (A), a supply port (P), and a tank port (T), respectively, and wherein a first component of a group including said displacement member, said cam element and said control member is rotatably driven with the aid of a drive mechanism, whereas a second component of the group with the exception of said control member is rotated as a result of the reaction forces, and a third component with the exception of said cam element is fixedly mounted in a housing of said hydraulic transformer.

2. The hydraulic transformer in accordance with claim 1, wherein said displacement member is mounted fixedly and said cam element is mounted rotatably, and said control member is driven.

3. The hydraulic transformer is accordance with claim 1, wherein said control member is mounted fixedly and said displacement member is mounted rotatably, and said cam member is driven.

4. The hydraulic transformer in accordance with claim 1, wherein said control member is mounted fixedly and said cam element is mounted rotatably, and said displacement member is driven.

5. The hydraulic transformer in accordance with claim 1, wherein a rotational speed control is associated with the drive mechanism.

6. The hydraulic transformer in accordance with claim 1, wherein the hydraulic transformer is realized in axial piston design and said control member is a valve plate, said cam element is a swash or wobble plate, and said displacement member is a drum with displacers.

7. The hydraulic transformer in accordance with claim 1, wherein the hydraulic transformer has the form of a vane-cell unit and said control member is a valve plate, said displacement member is a rotator with radially guided vanes and said cam element is a cam ring.

8. A hydraulic transformer comprising a multiplicity of displacers guided in a displacement member, delimiting a variable displacer volume, and supported on a cam element, wherein a pressure medium supply and discharge are controllable with the aid of a control member, the control member comprising a valve plate having at least three control kidneys that are connected with a work port (A), a supply port (P) and a tank port (T), respectively, and wherein the first component of a group including said displacement member, said cam element and said control member is rotatably driven with the aid of a drive mechanism, whereas a second component of the group with the exception of said control member is rotated as a result of the reaction forces, and a third component with the exception of said cam element is fixedly mounted in a housing of said hydraulic transformer, wherein said displacement member is fixedly mounted, and said cam element is rotatably mounted, and said control member is driven.

9. The hydraulic transformer in accordance with claim 8 wherein the hydraulic transformer has the form of a vane-cell unit and said displacement member is a rotator with radially guided vanes, and said cam element is a cam ring.

10. A hydraulic transformer comprising a multiplicity of displacers guided in a displacement member, delimiting a variable displacer volume, and supported on a cam element, where a pressure medium supply and discharge are controllable with the aid of a control member, the control member comprising a valve plate having at least three control kidneys that are connected with a work port (A), a supply port (P), and a tank port (T), respectively, and wherein a first component of a group including said displacement member, said cam element and said control member is rotatably driven with the aid of a drive mechanism, whereas a second component of the group with the exception of said control member is rotated as a result of the reaction forces, and a third component with the exception of said cam element is fixedly mounted in a housing of said hydraulic transformer, wherein said control member is fixedly mounted, and said displacement member is rotatably mounted, and said cam member is driven.

11. The hydraulic transformer in accordance with claim 10, wherein the hydraulic transformer has the form of a vane-cell unit and said displacement member is a rotator with radially guided vanes, and said cam element is a cam ring.

* * * * *